United States Patent [19]

Dean, Jr.

[11] Patent Number: 4,920,712

[45] Date of Patent: May 1, 1990

[54] CONCRETE RETAINING WALL BLOCK, RETAINING WALL AND METHOD OF CONSTRUCTION THEREFORE

[75] Inventor: Robert W. Dean, Jr., Milwaukee, Wis.

[73] Assignee: Stonewall Landscape Systems, Inc., Milwaukee, Wis.

[21] Appl. No.: 304,793

[22] Filed: Jan. 31, 1989

[51] Int. Cl.[5] ..... E02D 29/02; E04C 1/10

[52] U.S. Cl. ..... 52/169.4; 52/98; 52/562; 52/605; 52/606; 52/699; 52/747; 405/286

[58] Field of Search ..... 52/603, 605, 606, 608, 52/609, 562, 582, 699, 98, 742, 745, 747, 298, 718, 169.4; 405/286, 262

[56] References Cited

U.S. PATENT DOCUMENTS

| | | | |
|---|---|---|---|
| D. 295,788 | 5/1988 | Forsberg . | |
| D. 295,790 | 5/1988 | Forsberg . | |
| D. 296,007 | 5/1988 | Forsberg . | |
| D. 296,365 | 6/1988 | Forsberg . | |
| D. 297,464 | 8/1988 | Forsberg . | |
| D. 297,574 | 9/1988 | Forsberg . | |
| D. 297,767 | 9/1988 | Forsberg . | |
| D. 298,463 | 11/1988 | Forsberg . | |
| D. 299,067 | 12/1988 | Forsberg . | |
| 635,906 | 10/1899 | Wilson | 52/582 |
| 2,695,512 | 11/1954 | Paquet | 52/582 |
| 3,295,287 | 1/1967 | Pasquale | 52/562 |
| 4,335,549 | 6/1982 | Dean, Jr. . | |
| 4,379,659 | 4/1983 | Steiner . | |
| 4,521,138 | 6/1985 | Steiner . | |
| 4,661,023 | 4/1987 | Hilfiker | 405/286 |
| 4,738,059 | 4/1988 | Dean, Jr. . | |

FOREIGN PATENT DOCUMENTS

| | | | |
|---|---|---|---|
| 606523 | 12/1934 | Fed. Rep. of Germany | 52/603 |
| 964375 | 8/1950 | France | 52/609 |
| 2338352 | 8/1977 | France | 405/286 |
| 24690 | of 1902 | United Kingdom | 52/609 |

OTHER PUBLICATIONS

Keystone Retaining Wall Systems Specifications and Installation Guidelines brochure.
Keystone Retaining Wall Systems Product Profile Sheet.
Keystone Retaining Wall System Drawings.
Allan Block brochure.
Paverlock sheet.
Loffelstein ® Paver Systems, Inc. brochure.
Versa-Lok ® brochure.
Terrastop brochure.
Keystone Retaining Wall Systems Installation Guidelines brochure.

*Primary Examiner*—Carl D. Friedman
*Assistant Examiner*—Caroline D. Dennison
*Attorney, Agent, or Firm*—Andrus, Sceales, Starke & Sawall

[57] ABSTRACT

A specially constructed block for use in forming a mortarless retaining wall is disclosed, as is a retaining wall constructed therefrom and a method of constructing a retaining wall. Each block has a front face of a predetermined width and a rear wall having a substantially equal width. The block side walls provide a maximum block width at the front face and a minimum block width adjacent the rear wall. When such blocks are placed in a side-by-side relationship, a substantially closed cavity is formed between the blocks for receiving backfill material and thereby reinforcing the wall. A wall constructed from a plurality of such blocks utilizes an engagement clip disposed between blocks in upper and lower courses for preventing relative forward movement between the blocks. The clip is engageable with the upper surface of the rear web of the block for easy installation after the block is laid in a course. The clip engages the inner surface of the rear web of a block in an upper course, and is preferably disposed within the core of the upper block. Each block is provided with outwardly projecting ears which can be knocked off to form a wall having a radius of outside curvature, and the ears and clips cooperate to allow construction of a wall of inside curvature.

17 Claims, 3 Drawing Sheets

FIG. 1
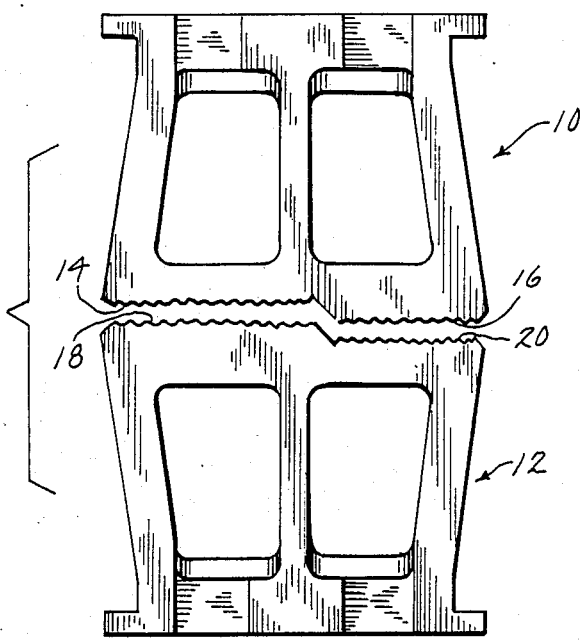
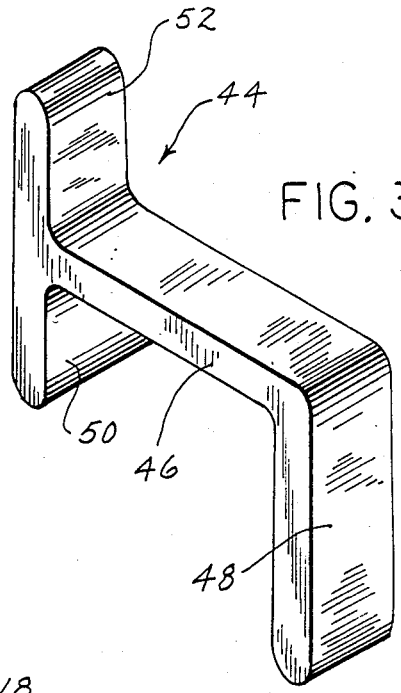
FIG. 3
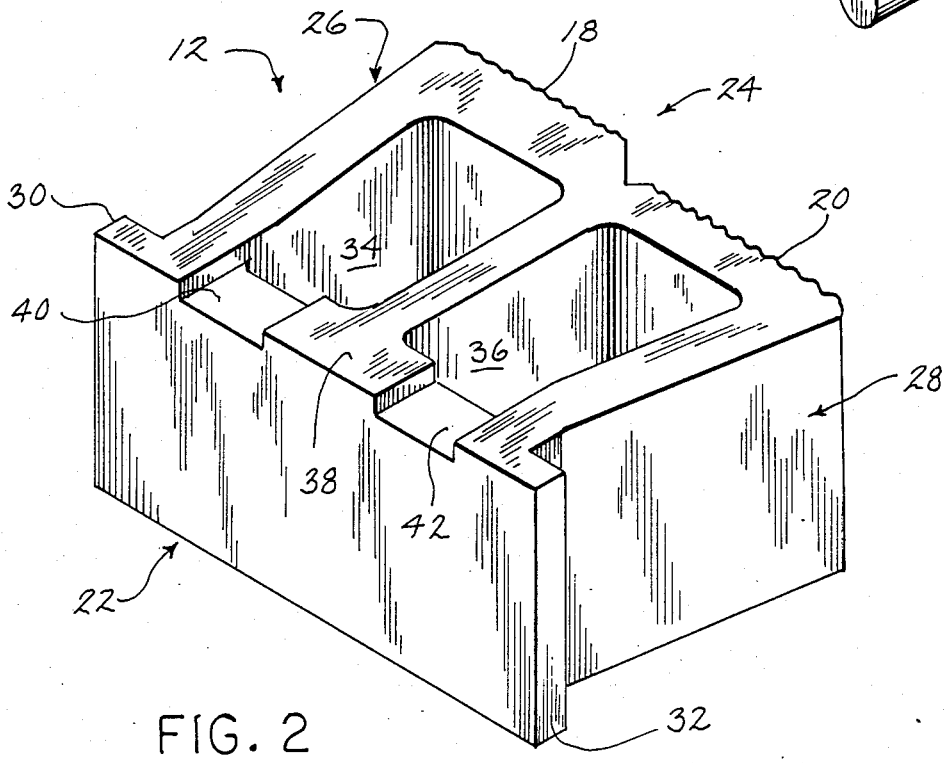
FIG. 2

FIG. 4
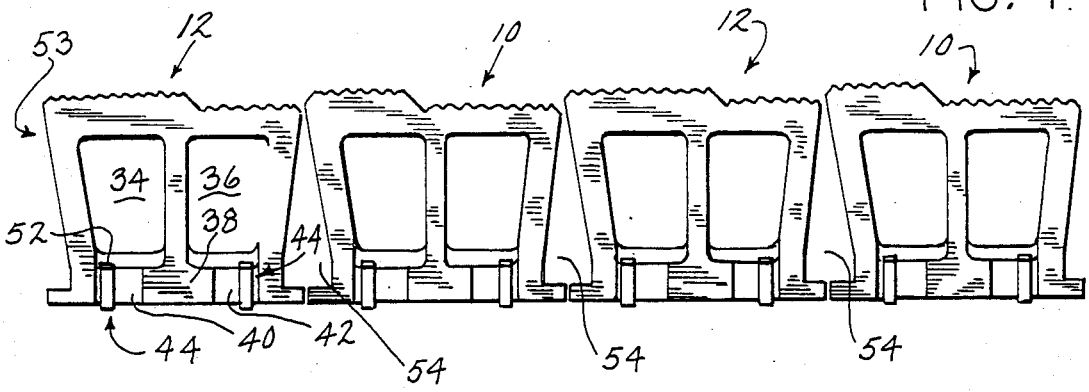
FIG. 5
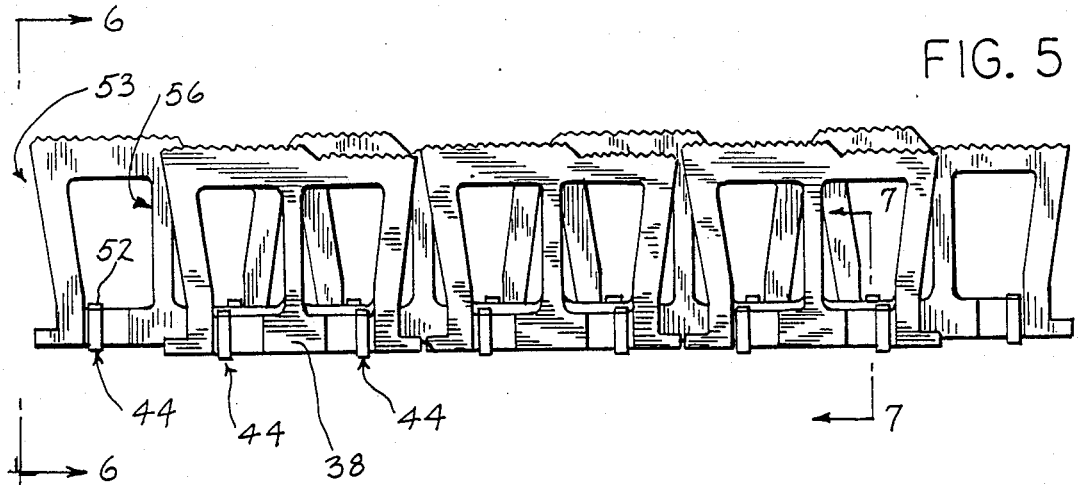
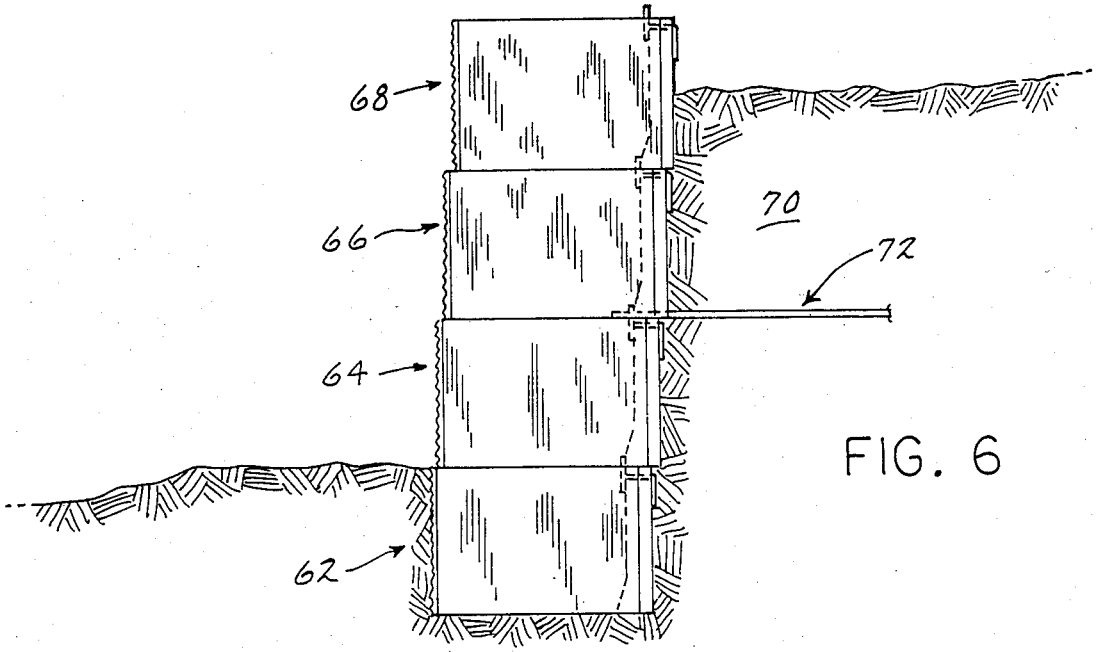
FIG. 6

CONCRETE RETAINING WALL BLOCK, RETAINING WALL AND METHOD OF CONSTRUCTION THEREFORE

BACKGROUND AND SUMMARY

This invention relates to a retaining wall and a block for constructing such a wall, and more particularly to a mortarless retaining wall system.

Retaining walls formed of concrete blocks are popular due to their long life and relative ease of construction when compared with other retaining wall materials, such as railroad ties or natural stone. In particular, mortarless construction of a retaining wall formed of concrete blocks can be rapidly constructed, and naturally provides adequate drainage and flexibility to accommodate changing loads which otherwise may cause a mortared wall to crack.

Various mortarless retaining wall systems are known, but all present difficulties either in block construction, shipping, or construction of the wall. It is an object of the present invention to provide a mortarless retaining wall system and a block for use therein, with the blocks being relatively light weight and easily manufactured and shipped. A wall formed from the blocks according to the invention is relatively easy to construct using semiskilled labor, yet is extremely durable and highly decorative.

In accordance with the invention, a block for use in a retaining wall is provided with a front outer wall presenting a block face having a predetermined width. The block further includes a rear wall spaced from the front wall having a width substantially equal to the predetermined width of the front wall. A pair of side walls extend between the front wall and the rear wall, and provide a reduced width to the block in a front-to-rear direction so that the maximum block width is provided at the front face and at the rear wall. An area of minimum block width is provided adjacent the rear wall. Portions projecting outwardly from the area of minimum block width form a pair of projecting ears at the rear wall. The block is preferably formed from a composite module which is cast and then split along two separate and distinct splitting planes to form a variable depth split block face. Each block is preferably provided with one or more cores therethrough to reduce the weight of the block.

The blocks are described above are used to form a linear retaining wall by placing a plurality of such blocks in a side-by-side relationship such that the ends of the outer front wall of one block are placed closely adjacent the ends of the outer front walls of adjacent blocks to form a course. The ends of the rear wall are likewise positioned closely adjacent the ends of the rear walls of the neighboring blocks, so that a cavity is formed between the blocks. The width of the cavity is defined by the side walls of the neighboring blocks. The cavity is adapted to be filled with a backfill material for reinforcing the strength of the wall constructed from the blocks.

Engagement means is preferably provided between the blocks in adjacent courses so as to prevent forward movement of blocks in an upper course relative to blocks in a lower course. The engagement means is preferably mounted to the rear web of each block, which is the area disposed between the block core and the rear wall of each block. The engagement means preferably comprises a clip having a mounting portion for mounting to the upper surface of the rear web of each block, and an upwardly projecting portion for projecting above the upper surface of the block when the clip is mounted thereto. The upwardly projecting portion of the clip is adapted to engage the rear web of a block exposed in a course thereabove, so as to prevent forward movement of the upper block relative to block to which the clip is mounted. In a preferred embodiment, the upwardly projecting portion of each clip includes a block engaging portion which is substantially aligned with the inner surface of the rear web of the block to which the clip is mounted. A block in a course thereabove is positioned on the lower block so that the block engaging portion of the clip engages the inner surface of the rear web of the upper block. In this manner, the upper block can be positioned on the lower block such that the upwardly projecting portion of the clip mounted to the lower block projects into the core of the upper block, whereafter the upper block is slid forwardly so as to engage the inner surface of the rear web of the block with the block engaging portion of the upstanding clip portion. This facilitates easy installation of the clip blocks and quick construction. The core through the block preferably defines the inner surface of the rear web of the block so that the inner surface provides a rear web having an increased thickness adjacent the lower block surface than adjacent the upper block surface. With this construction of the blocks, a predetermined setback is provided for blocks in the upper course relative to the lower course when the blocks are installed as above described.

A method of constructing a block wall is also contemplated by the present invention, comprising a series of steps generally in accordance with the above discussion.

BRIEF DESCRIPTION OF THE DRAWINGS

The drawings illustrate the best mode presently contemplated of carrying out the invention.

In the drawings:

FIG. 1 is an upper plan view of a pair of blocks constructed according to the invention as split from a composite module;

FIG. 2 is a rear isometric view of one of the blocks shown in FIG. 1;

FIG. 3 is an isometric view of a clip for use in constructing a wall with a plurality of blocks as shown in FIG. 1;

FIG. 4 is a top plan view of a lower course in a straight wall constructed from a plurality of blocks as shown in FIG. 3;

FIG. 5 is a view similar to FIG. 4, showing an upper course placed on the lower course of blocks;

FIG. 6 is a side elevation view looking generally in the direction of line 6—6 of FIG. 5;

DETAILED DESCRIPTION OF THE PREFERRED EMBODIMENT

Figure 7:
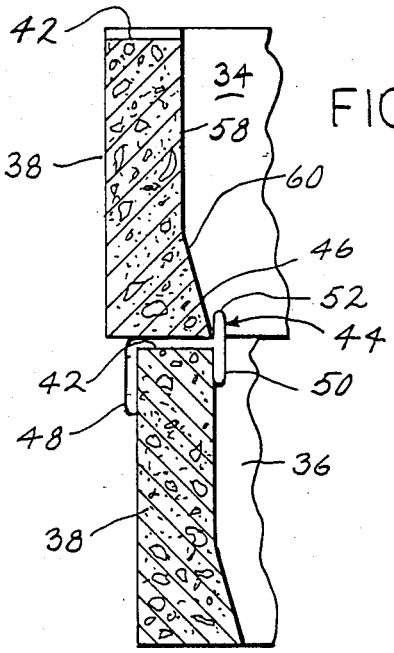
FIG. 7 is an enlarged partial sectional view taken generally along line 7—7 of FIG. 5.
Figure 8:
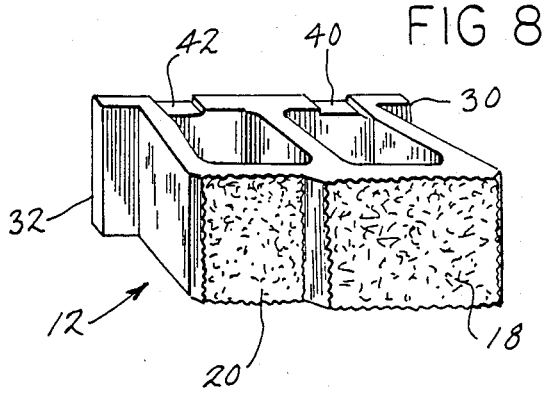
FIG. 8 is a front isometric view of the block of FIG. 3.

As shown in FIG. 1, a pair of concrete blocks 10, 12 are split from a cured composite module, which is cast using a single mold. Block 10 has a pair of front outer faces 14, 16 split along separate splitting planes. Similarly, block 12 has faces 18, 20 split along separate splitting planes, such that faces 14, 16 and 18, 20 are complementary in nature. For a discussion of splitting of a composite module along separate, spaced splitting planes, reference is made to U.S. Pat. Nos. 4,335,549 and 4,738,059, both to Dean, Jr., which are hereby incorporated by reference.

Except for the front wall of each block, blocks 10 and 12 are identical in construction. Accordingly, like reference characters will be used in describing blocks 10, 12.

With reference to FIG. 3, block 12 includes a rear wall 22 spaced rearwardly of a front wall 24, which includes split surface areas 18, 20. A pair of side walls, shown at 26, 28 extend between front wall 24 and rear wall 22. As shown, side walls 26, 28 provide a maximum block width at front wall 24, and taper in a front-to-rear direction so as to provide a minimum block width adjacent rear wall 22. A pair of ears 30, 32 project outwardly from rear wall 22 rearwardly of the area of minimum block width as defined by side walls 26, 28. Ears 30, 32 provide a width to rear wall 22 substantially equal to that of front wall 24. A pair of cores 34, 36 are formed in block 12. The area of block 12 between cores 34, 36 and rear wall 22 defines a rear web 38.

As shown, a pair of recesses 40, 42 are formed in the upper surface of rear web 38.

A clip, shown generally at 44 in FIG. 2, is adapted for mounting to block 12 at one of its recesses 40, 42 formed in rear web 38. Clip 44 includes an upper transverse member 46 from which a pair of legs 48, 50 depend. An upwardly projecting portion 52 is substantially aligned with depending leg 50 and projects above upper transverse member 46.

As shown in FIG. 4, a lower course 53 is formed from a plurality of blocks 10, 12 placed in a side-by-side relationship. Blocks 10, 12 are placed so that the ends of the front wall of each block are placed closely adjacent the respective end of the front wall of a neighboring block in course 52. Similarly, ears 30, 32 provided at rear wall 22 of each block are placed so that their ends are closely adjacent the respective ears of neighboring blocks. In this manner, a substantially closed cavity, shown at 54, is provided between each block 10, 12 as placed in course 52. After construction of lower course 53, the block cores 34, 36 are filled with a backfill material, as are cavities 54 between the blocks 10, 12. In this manner, the strength of the wall formed by successive block courses is reinforced.

With further reference to FIG. 4, a clip 44 is disposed within each recess 40, 42 provided in the upper surface of rear web 38 of each of blocks 10, 12. Each clip 44 is oriented within its respective recess such that its depending leg 48 is adjacent to and engaging rear wall 22, and its depending leg 50 is adjacent to and engaging the inner surface of rear web 38. When clip 44 is so positioned, upwardly projecting portion 52 is oriented such that its rearface is substantially in line with the inner surface of rear web 38 adjacent the recess within which clip 44 is disposed.

With reference to FIG. 5, an upper course 56 of blocks 10, 12 is adapted for placement on top of the blocks forming lower course 53. The blocks forming upper course 56 are placed in a staggered relationship relative to the blocks forming lower course 53, so that the blocks in upper course 56 overlap the joint between blocks in lower course 53. As is known in block wall construction, this arrangement strengthens the wall so formed.

As shown, the blocks in upper course 56 are placed on the blocks in lower course 53 such that the upwardly projecting portion 52 of each clip 44 placed on a block in lower course 53 is disposed within a core of a block forming upper course 56. The blocks in upper course 56 are then moved forwardly so that the rearface of upstanding portion 52 of each clip 44 engages the inner surface of rear web 38 of the blocks in upper course 56. In this manner, forward movement of the blocks in upper course 56 relative to the blocks in lower course 53 is prevented. This series of construction steps is repeated in successive block courses. That is, clips 44 are placed within the recesses formed in rear webs 38 of the blocks in upper course 56 so as to engage and retain blocks placed thereabove in yet another course.

With reference to FIG. 7, it is seen that each of cores 34, 36 through a block is formed so as to define the inner surface of rear web 38 so as to provide a greater thickness to rear web 38 adjacent the lower block surface than adjacent the upper block surface. As shown, the inner surface of rear web 38 includes a substantially vertical portion 58 and a lower tapered portion 60. With this construction of each block, an automatic offset of blocks in an upper course is provided relative to blocks in a lower course when the wall is constructed as described above. When a block in an upper course is positioned on a block in a lower course such that the upwardly projecting portion 52 of clip 44 projects into the core of the upper block, and the upper block is moved fowardly until engagement with the rearface of upwardly projecting portion 52 of clip 44, the increased thickness of the rear web of the upper block at its lower surface will provide the noted rearward offset. Such an offset provides an increase in the strength and stability of the wall so formed.

With further reference to FIG. 7, upper transverse member 46 of clip 44 is placed within a recess, such as 42, formed in the upper surface of rear web 38 of the lower course block. Recess 42 has a depth sufficient to prevent any portion of upper transverse member 46 from projecting above the upper surface of rear web 38.

As shown in FIG. 6, a plurality of successive courses of blocks forming a wall is shown. The lower course, shown at 62, is substantially buried while the upper courses, 64, 66 and 68 have their outer faces exposed and providing the described rearward offset. Fill material, shown at 70, is placed adjacent the rear faces of each block forming the wall, which material is retained by the wall formed from courses 62–68. A reinforcing grid structure, such as that shown representatively at 72, can be installed to tie the wall formed from courses 62–68 back into the fill material for further reinforcing the strength of the wall. The reinforcement 72 is preferably a grid type material which is engageable with upstanding portion 52 of clip 44 for securing reinforcement 72 to the blocks forming the wall.

Figure 9:
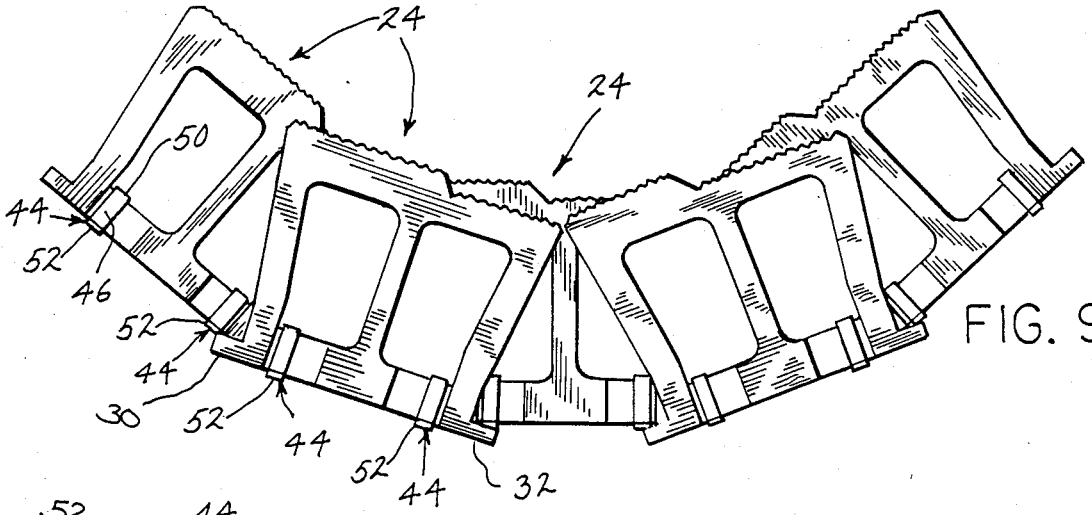
FIG. 9 is a top plan view of two courses of an inside radius of curvature wall formed from a plurality of blocks according to the invention.

As shown in FIG. 9, an inside radius wall can be formed from a plurality of blocks by placing the blocks such that the ends of their outer front surfaces are closely adjacent each other, and the ends of the rear walls are spaced appropriately to provide the desired inside radius of curvature. When an inside radius wall of the type shown is formed, clips 44 are reversed when mounted within the recesses formed in the upper surfaces of the rear web of each block so that the upstanding projecting portion 52 no longer projects upwardly into the core of a block in an adjacent course. Rather, upstanding portion 52 engages the forward surface of ears 30, 32 for preventing relative forward movement between the blocks in successive courses.

Figure 10:
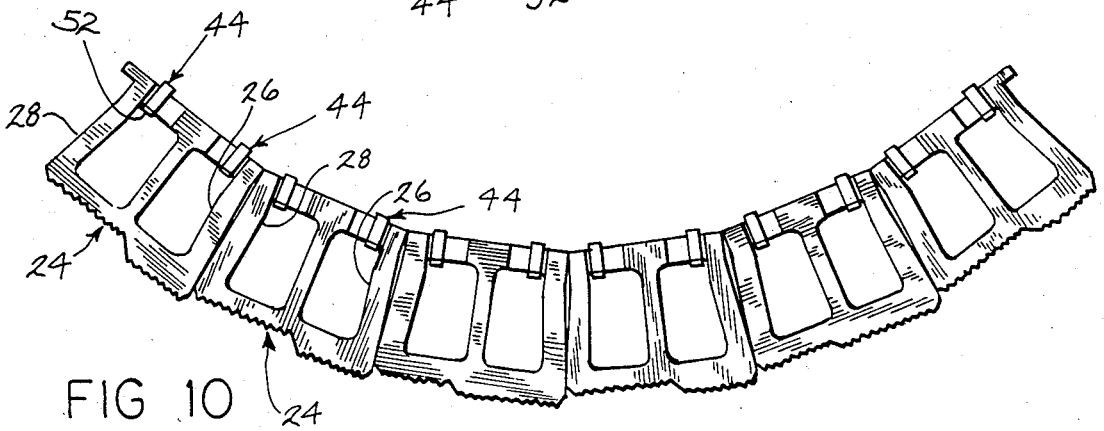
FIG. 10 is a top plan view of a single course of an outside radius of curvature wall formed from the blocks of the invention.

As shown in FIG. 10, a wall having an outside radius can be formed by knocking off ears 30, 32 at the rear of each block and placing side walls 26, 28 of each block closely adjacent the side walls of neighboring blocks. In this arrangement, clips 44 are disposed in the first-described manner wherein the upwardly projecting portion 52 of each clip 44 extends into the core of blocks in adjacent upper courses.

It should be appreciated that a flexible and versatile system is provided by the described block and retaining wall construction and method. The blocks can be easily stacked and cubed for convenient shipment, and are relatively light in weight when compared to prior art retaining wall construction blocks. Further, the interlocking of blocks in adjacent courses by utilization of the clips projecting into the block cores of blocks in the upper course eases installation when compared to prior art retaining wall systems. The width of the grooves provided in the upper surface of the rear block webs allows lateral movement of the clips to accommodate construction tolerances.

The provision of the ears at the rear walls of each block provides highly satisfactory construction of straight, inwardly curved and outwardly curved walls. As noted for a straight wall, the ears cooperate to form a substantially closed cavity for receiving backfill material to strengthen the wall. In an inwardly curved arrangement, the ears engage the clips provided on the blocks in the course therebelow to prevent forward movement of the upper blocks. In an outwardly curved situation, the ears are knocked off to provide the desired curvature.

Various alternatives and modifications are contemplated as being within the scope of the following claims particularly pointing out and distinctly claiming the subject matter regarded as the invention.

I claim:

1. A retaining wall comprising:

a plurality of stacked, individual blocks, each said block comprising:

a front outer wall presenting a block face having a predetermined width;

a rear wall spaced from said front wall and having a width substantially equal to that of said front wall;

a pair of side walls extending between said front outer wall and said rear wall, an upper block surface; and a lower block surface;

wherein each said block is provided with a core therethrough, with the area of said block disposed between the core and the rear wall of said block defining a rear web;

said wall being formed by a plurality of courses of said blocks, with a joint being formed between the blocks in adjacent upper and lower courses by the lower and upper block surfaces, respectively, of the blocks forming said upper and lower courses, each said course comprising a plurality of said blocks placed in a side-by-side relationship, wherein each end of the front outer wall of each block is located closely adjacent an end of the front outer wall of its neighboring block, and each end of the rear wall of each block is located closely adjacent an end of the rear wall of its neighboring block;

engagement means interposed between the blocks in adjacent courses for preventing relative forward movement between the blocks in adjacent courses, said engagement means comprising clip means mountable to the rear web of a block in one of said upper and lower courses, said clip means including a substantially horizontal portion for placement adjacent the surface of said block forming said joint, and a substantially vertical projecting portion adapted to engage the rear web of a block placed in an adjacent course for preventing forward movement of blocks in an upper course relative to blocks forming the course therebelow; and a recess formed in one of said block surfaces forming said joint for receiving the substantially horizontal portion of said clip means to prevent interference thereof with said joint, with the vertical projecting portion of said clip means projecting outwardly past said recess

2. The retaining wall of claim 1, and further comprising backfill material placed within the core of each said block for reinforcing each said course.

3. The retaining wall of claim 1, wherein said rear web includes an inner surface forming said core, and wherein said clip means projecting portion engages the inner surface of the rear web of a block in an adjacent course.

4. The retaining wall of claim 3, wherein said clip means projecting portion includes a block engaging portion substantially in line with the inner surface of the rear web of the block to which said clip means is mounted.

5. The retaining well of claim 4, wherein said clip means is mounted to the lower block of blocks in adjacent courses, and wherein the inner surface of the rear web of each said block has a greater transverse dimension adjacent the lower block surface than adjacent the upper block surface, so that when said clip means is mounted to a block in a lower course, and a block in an upper course is placed on said lower course block such that the inner surface of the upper block rear web abuts the block engaging portion of said clip means upstanding member, the front outer wall of the upper course block is offset rearwardly relative to the front outer wall of the lower course block.

6. The retaining wall of claim 1, wherein said recess comprises a substantially transverse groove formed in said rear web adjacent the surface of said block forming said joint, said groove being adapted to accommodate said clip means such that the horizontal portion of said clip means does not project above the plane of said rear web surface.

7. The retaining wall of claim 1, wherein each said block face comprises two or more substantially planar split surface areas spaced at different depths from said rear wall to provide a decorative appearance to said wall.

8. The retaining wall of claim 1, wherein each said side wall of said blocks tapers inwardly in a front-to-rear direction to provide a minimum block width adjacent said rear wall and a maximum block width adjacent said front outer wall, and wherein a pair of projecting ears extend from said minimum block width to said predetermined width.

9. The retaining wall of claim 8, wherein said projecting ears are adapted for knock-off removal, and wherein an outside radius of curvature is provided to said wall by removal of said ears and placing the side walls of adjacent blocks in a course against each other, so that said tapered side walls of said blocks cooperate to orient the front outer walls of adjacent blocks in a non-coplanar relationship.

10. The retaining wall of claim 8, wherein said clip means is mounted to said block such that a block engaging portion of its vertical projecting portion is substantially in line with the outer face of the rear wall of said block, and wherein an inside radius is provided to said wall by placing adjacent blocks such that the ends of their outer front walls are closely adjacent each other and the ends of their rear walls are substantially spaced from each other so that the outer front walls of adjacent blocks are oriented in a non-coplanar relationship, and wherein the block-engaging portion of said clip means engages the inner surface of the projecting ears of the block placed above the block to which said clip means is mounted.

11. A retaining wall, comprising:

a plurality of stacked, individual blocks, each said block comprising:

a front outer wall presenting a block face;

a rear wall spaced from said front wall;

a pair of side walls extending between said front wall and said rear wall;

an upper block surface; and a lower block surface;

each said block having one or more cores therethrough, with the area of said block disposed between the core and the rear wall of said block defining a rear block web;

said wall being formed by a plurality of courses of said blocks, with a joint being formed between the blocks in adjacent upper and lower courses by the lower and upper block surfaces, respectively, of the blocks forming said upper and lower courses, each said course comprising a plurality of blocks placed in a side-by-side relationship;

engagement means interposed between the blocks in adjacent courses for preventing relative forward movement therebetween, said engagement means comprising clip means including a mounting portion adapted for push-on engagement with the rear block web of a block in one of said upper and lower courses, said clip means further including a substantially vertical projecting portion extending past the surface of the block forming said joint, to which said clip means is mounted, said projecting portion being adapted to engage the rear web of a block placed in an adjacent course for preventing relative forward movement between blocks in adjacent courses; and a recess formed in one of said block surfaces forming said joint for receiving a portion of said clip mounting portion adjacent thereto to prevent interference thereof with said joint.

12. The retaining wall of claim 11, wherein said clip means mounting portion includes a horizontal member and a pair of vertical legs, said horizontal member being adapted for placement adjacent the surface of said rear block web forming said joint, and said legs being adapted for placement on said rear block web such that one leg engages the inner surface thereof and the other said leg engages the outer surface thereof.

13. The retaining wall of claim 12, wherein said clip means projecting portion extends beyond said clip means horizontal member, and includes a block engaging surface substantially in line with the inner surface of said rear block web at the point where said clip means is mounted thereto, said block engaging surface being adapted to engage the inner surface of the rear block web of a block placed in the course containing the block to which said clip means is mounted, for preventing relative forward movement of blocks in adjacent courses.

14. The retaining wall of claim 13, wherein the core through each said block defines a rear block web having an inner surface providing a greater rear web thickness adjacent the lower block surface than that adjacent the upper block surface, so that when said clip means is mounted to a block in a lower course and a block in an upper course is placed on said lower course block such that its inner rear web surface is engaged with said upper block engaging surface of said clip means, the front outer wall of the upper course block is offset rearwardly relative to the front outer wall of the lower course block.

15. The retaining wall of claim 11, wherein a pair of said clip means is mounted to the rear web of each said block.

16. A method of constructing a retaining wall from a plurality of blocks, comprising the steps of:

providing a plurality of blocks, each said block comprising a front outer wall presenting a block face; a rear wall spaced from said front wall; a pair of side walls extending between said front wall and said rear wall; an upper block surface; and a lower block surface; each said block having one or more cores therethrough, with the area of said block disposed between the core and the rear wall of said block defining a rear web;

forming a recess extending transversely across said rear web and opening onto one of the upper or lower surfaces;

placing a first series of said blocks in a side-by-side relationship to form a lower course of said blocks;

placing a second series of said blocks on said first series of blocks to form an upper course above said lower course, with a joint being formed between blocks in said upper and lower courses by the lower and upper surfaces, respectively, of blocks forming said upper and lower courses;

providing a clip including a block mounting portion and a portion projecting therefrom; and mounting said clip to the rear web of the blocks in one of said courses such that the block mounting portion thereof is disposed within said recess so as not to interfere with said joint, with the projecting portion of said clip extending past the surface of said block onto which said recess opens;

wherein said second series of said blocks are placed on said first series of said blocks such that the rear web of blocks in one course are engaged by the projecting portion of said clip mounted to the rear web of blocks in the adjacent course, so as to prevent forward movement of the blocks in said upper course relative to the blocks in said lower course.

17. A retaining wall, comprising a plurality of stacked, individual blocks, each said block comprising:

a front outer wall presenting a block face;

a rear wall spaced from said front wall;

a pair of side walls extending between said front wall and said rear wall;

an upper block surface; and a lower block surface;

each said block having one or more cores therethrough, with the area of said block disposed between the core and the rear wall of said block defining a rear web, wherein said rear web includes an inner surface forming said core and having a greater thickness adjacent the lower block surface than that adjacent the upper block surface;

said wall being formed by plurality of courses of said blocks, with a joint being formed between the blocks in adjacent upper and lower courses by the lower and upper block surfaces, respectively, of the blocks forming said upper and lower courses, each said course comprising a plurality of blocks placed in a side-by-side relationship; and engagement means interposed between the blocks in adjacent courses for preventing relative forward movement therebetween, said engagement means including a mounting portion adapted for engagement with the rear web of a block in a lower course, and an upwardly projecting portion extending above the upper surface of the block to which said engagement means is mounted, said upwardly projecting portion engaging the inner surface of the rear web of a block in the course thereabove adjacent the lower surface of said block, so that the front outer wall of the upper course block is offset rearwardly relative to the front outer wall of the lower course block.

* * * * *

UNITED STATES PATENT AND TRADEMARK OFFICE

CERTIFICATE OF CORRECTION

PATENT NO. : 4,920,712

DATED : 5/1/90

INVENTOR(S) : Robert W. Dean, Jr.

It is certified that error appears in the above-identified patent and that said Letters Patent is hereby corrected as shown below:

Claim 1, Col. 6, Line 26, After "recess" add --- . ---;

Claim 5, Col. 6, Line 40, Delete "well" and substitute therefor --- wall ---;

Claim 8, Col. 7, Line 3, Delete "predetermined" and substitute therefor --- maximum ---.

Signed and Sealed this

Fifth Day of May, 1992

*Attest:*

DOUGLAS B. COMER

*Attesting Officer*

*Acting Commissioner of Patents and Trademarks*